United States Patent [19]

Ohtsuka et al.

[11] Patent Number: 4,844,838

[45] Date of Patent: Jul. 4, 1989

[54] METHOD OF TREATMENT OF RADIOACTIVE LIQUID WASTE

[75] Inventors: Katsuyuki Ohtsuka, Mito; Yoshiharu Takahashi, Katsuta, both of Japan

[73] Assignee: Doryokuro Kakunenryo Kaihatsu Jigyodan, Tokyo, Japan

[21] Appl. No.: 154,213

[22] Filed: Feb. 10, 1988

[30] Foreign Application Priority Data

Feb. 13, 1987 [JP] Japan ..... 62-31101

[51] Int. Cl.[4] ..... G21F 9/16

[52] U.S. Cl. ..... 252/629; 252/628; 252/631; 376/310

[58] Field of Search ..... 252/629, 631, 628, 627, 252/626; 376/310

[56] References Cited

U.S. PATENT DOCUMENTS

| | | | |
|---|---|---|---|
| 3,716,490 | 2/1973 | Van de Voorde | 252/628 |
| 4,253,985 | 3/1981 | Filter et al. | 252/628 |
| 4,487,711 | 12/1984 | Pope et al. | 252/629 |
| 4,500,449 | 2/1985 | Kuhnke et al. | 252/628 |
| 4,540,512 | 9/1985 | Lahoda | 252/629 |
| 4,643,846 | 2/1987 | Kanai et al. | 252/626 |
| 4,710,318 | 12/1987 | Horiuchi et al. | 252/628 |

FOREIGN PATENT DOCUMENTS

| | | | |
|---|---|---|---|
| 0042770 | 12/1981 | European Pat. Off. | 252/629 |
| 0046085 | 2/1982 | European Pat. Off. | 252/629 |
| 0067495 | 12/1982 | European Pat. Off. | 252/629 |
| 1145500 | 7/1986 | Japan | 252/631 |

*Primary Examiner*—Howard J. Locker

*Attorney, Agent, or Firm*—Wenderoth, Lind & Ponack

[57] ABSTRACT

A method of treatment of a radioactive liquid waste containing fission products and a thermally decomposable sodium compound which comprises heating the liquid waste to convert the sodium compound into oxides of sodium, converting the oxides into sodium hydroxide, reacting the sodium hydroxide with an alcohol to form a sodium alcoholate, separating the sodium alcoholate from an impurity residue essentially comprising fission products, decomposing the separated sodium alcoholate to form sodium hydroxide and recovering the sodium hydroxide.

6 Claims, 2 Drawing Sheets

METHOD OF TREATMENT OF RADIOACTIVE LIQUID WASTE

BACKGROUND OF THE INVENTION

The present invention relates to a method of treatment of a radioactive liquid waste including high-level liquid waste and medium- or low-level liquid waste produced from a reprocessing plant, to decompose sodium compounds contained in the liquid waste for the recovery and reuse of sodium and for the volume reduction of the radioactive liquid waste to be disposed, thus facilitating the vitrification or bitumen solidification of the liquid waste.

High-level liquid waste produced from a reprocessing plant essentially comprises a large amount of sodium nitrate and a small amount of fission products. This type of liquid waste is generally vitrified by melting it together with a large amount of a glass forming agent.

On the other hand, medium- or low-level liquid waste substantially comprises sodium nitrate and a slight amount of fission products. This type of liquid waste is generally mixed with bitumen under heating and the mixture is solidified and discarded.

In order to obtain a vitrified product having excellent properties, the sodium content in the product must be below a specified limit. Therefore, in order to convert a large amount of high-level liquid waste into a vitrified product having excellent properties, a large amount of a glass forming agent must be used, which disadvantageously brings about an increase in the amount of waste.

Further, in the treatment of medium- or low-level liquid waste, the mixing of sodium nitrate with bitumen under heating involves risk of fire or explosion. Thus much attention is required and the working efficiency is poor.

SUMMARY OF THE INVENTION

It is therefore an object of the present invention to overcome the above-described disadvantages in the prior art and to provide an improved method of treatment of a radioactive liquid waste, which permits the recovery and reuse of sodium by decomposing thermally decomposable sodium compounds contained in the liquid waste, while the resulting impurity residue essentially comprising fission products is converted into a stable form exhibiting a high safety.

Another object of the present invention is to provide a method of treatment of a radioactive liquid waste, which permits the removal of sodium in the liquid waste, so that the remarkable volume reduction of waste to be disposed of can be accomplished, a vitrified product having excellent properties can be produced and the risk of fire or explosion in the bitumen solidification can be greatly reduced.

According to the present invention, there is provided a method of treatment of a radioactive liquid waste comprising the following steps:

(1) a heating step wherein a radioactive liquid waste containing fission products and a thermally decomposable sodium compound is heated to convert the sodium compound into oxides of sodium, so that a calcination product comprising fission products and oxides of sodium is formed, (2) a reaction step wherein the oxides of sodium in the calcination product are converted into sodium hydroxide, (3) a purification step wherein the sodium hydroxide in the calcination product is reacted with an alcohol to form a sodium alcoholate, and the thus formed sodium alcoholate is separated by solid-liquid separation from an impurity residue comprising the fission products, and (4) a decomposition step wherein the sodium alcoholate is decomposed to form and recover sodium hydroxide.

The impurity residue obtained in the above step (3) may further be subjected with vitrification or bitumen solidification according to a conventional solidification process.

In the method of the present invention, the thermally decomposable sodium compound contained in the radioactive liquid waste is converted into sodium oxide and sodium peroxide by heating. The oxide and peroxide are converted into sodium hydroxide by the reaction with water vapor or the like. The sodium hydroxide, which contains therein fission products, is reacted with alcohol to convert the sodium hydroxide into sodium alcoholate. The thus formed alcoholate is then separated from the impurity residue comprising fission products. The separated sodium alcoholate is decomposed with water to form sodium hydroxide, which may then be recovered.

As described above, the sodium contained in the radioactive liquid waste can be separated and recovered, while only impurities essentially comprising fission products remain as a residue. Therefore, the volume of radioactive waste to be solidified can be remarkably reduced.

Further, the impurity residue produced in the present invention hardly contains sodium, so that it can be vitrified into a solidified product having excellent properties or can be safely treated by bitumen solidification.

PREFERRED EMBODIMENTS OF THE INVENTION

Figure 1:
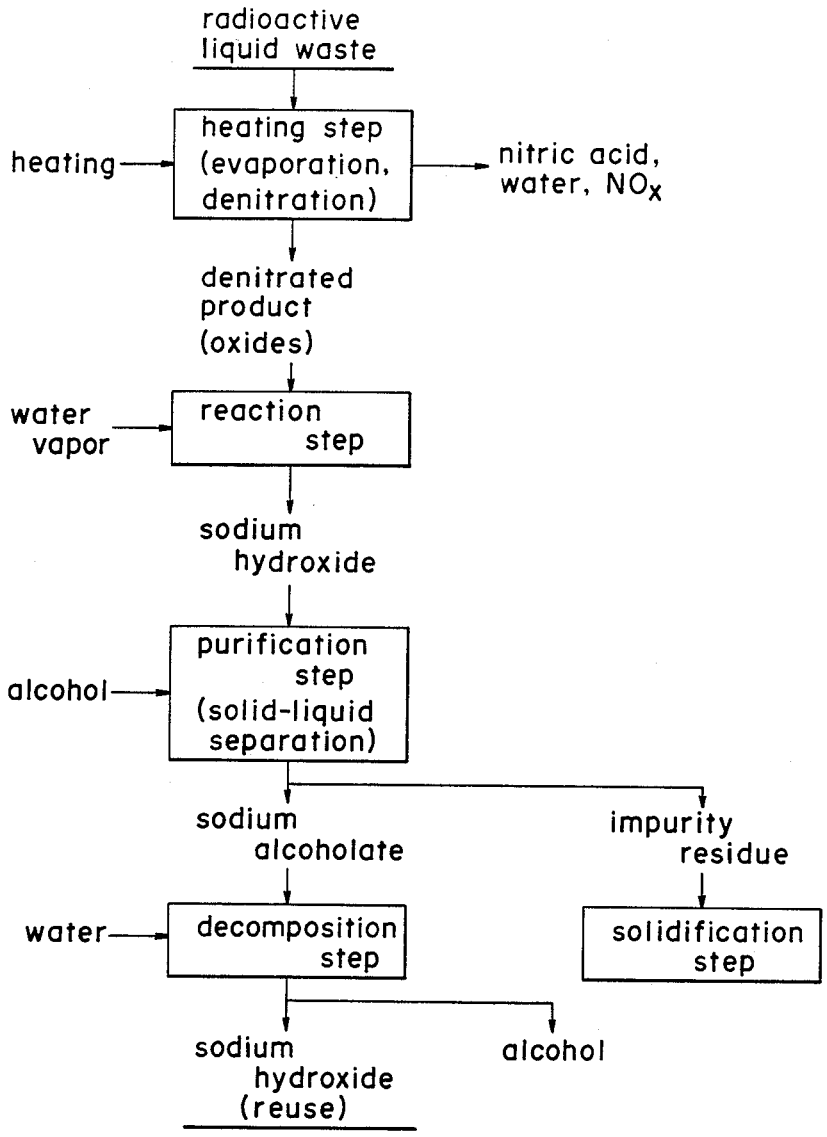
FIG. 1 is a flow chart illustrating the method of treatment of a radioactive liquid waste according to the present invention.

FIG. 1 is a flow chart showing the method of treatment of a radioactive liquid waste according to the present invention. First, a radioactive liquid waste containing fission products and a thermally decomposable sodium compound such as sodium nitrate is transferred to a heating step to be heated therein. In this heating step, the evaporation and denitration of the liquid waste are carried out and the nitrate and water contained therein are evaporated. By further heating, the thermal decomposition proceeds and a nitrogen oxide ($NO_X$) gas is eliminated. For example, sodium nitrite is decomposed at 320° C., while sodium nitrate is decomposed at 380° C. Accordingly, the heating of the radioactive liquid waste may be carried out at a suitable temperature exceeding these temperatures. It is preferred to use microwave as a heat source in the heating step, because microwave heating gives a porous calcination product. By continuing the heating, there is formed a calcination product or denitrated product essentially comprising fission products, sodium oxide and sodium peroxide. Among initial fission products, volatile nuclides are evaporated by the above heating, so that the exhaust gas must be separately subjected to necessary treatment such as condensation, adsorption or absorption. Most of the nonvolatile nuclides are converted into oxides by the above heating.

Then, the denitrated product (oxides) thus formed are transferred to a reaction step. In this reaction step, water vapor is sprayed directly to the denitrated product to convert the oxides into sodium hydroxide. In order to carry out the formation of sodium hydroxide more gently, the denitrated product may be reacted with carbon dioxide gas to convert the oxides of sodium into sodium carbonate, which is then converted to sodium hydroxide by reacting sodium carbonate with water vapor.

The thus obtained sodium hydroxide containing fission products is transferred to a purification step. In this step, the sodium hydroxide is dissolved in a pure alcohol such as ethyl alcohol to be converted into its ethylate (sodium ethoxide), and the thus obtained sodium ethylate is separated by solid-liquid separation from an impurity residue. The impurity residue essentially comprises fission products.

The separated sodium ethylate is then transferred to a decomposition step. In this step, the ethylate is decomposed with water into ethyl alcohol and sodium hydroxide. The sodium hydroxide is recovered and reused.

The impurity residue separated in the purification step may be transferred to a solidification step. In this step, the residue is melted together with a glass forming agent to be vitrified. Alternatively, it is mixed with bitumen under heating to produce a product solidified by bitumen. Since the sodium content of the impurity residue is remarkably reduced, a vitrified product having excellent properties can be formed by the vitrification or the risk of fire and explosion can be reduced in the bitumen solidification. Thus, in either case, the volume of the radioactive liquid waste to be solidified can be greatly reduced.

Some of the steps constituting the method of the present invention can be applied to the treatment of a metallic sodium waste accompanied with a radioactive corrosive product from a fast breeder reactor. Such a waste containing metallic sodium is generally washed with water vapor or the like and the condensed liquid waste is subjected to vaporization by heating and concentration, and the concentrated liquid waste is melted together with a small amount of a glass forming agent to be vitrified. However, the obtained vitrified product exhibits unfavorable properties including deliquescence. In order to solve this problem, the treatment of the metallic sodium waste from a fast breeder reactor may be carried out as follows: the metallic sodium waste is directly contacted with water vapor to convert the metallic sodium into sodium hydroxide. The obtained sodium hydroxide is then transferred to the purification step of the present invention, in which the sodium hydroxide is reacted with an alcohol to form a sodium alcoholate. Then, the sodium alcoholate is separated from an impurity residue, and the separated sodium alcoholate is decomposed into sodium hydroxide. This application of the latter two steps of the method according to the present invention to the metallic sodium waste from a fast breeder reactor allows the reuse of sodium and the vitrification of the impurity residue into an excellent vitrified product, similarly to the method according to the present invention.

Figure 2:
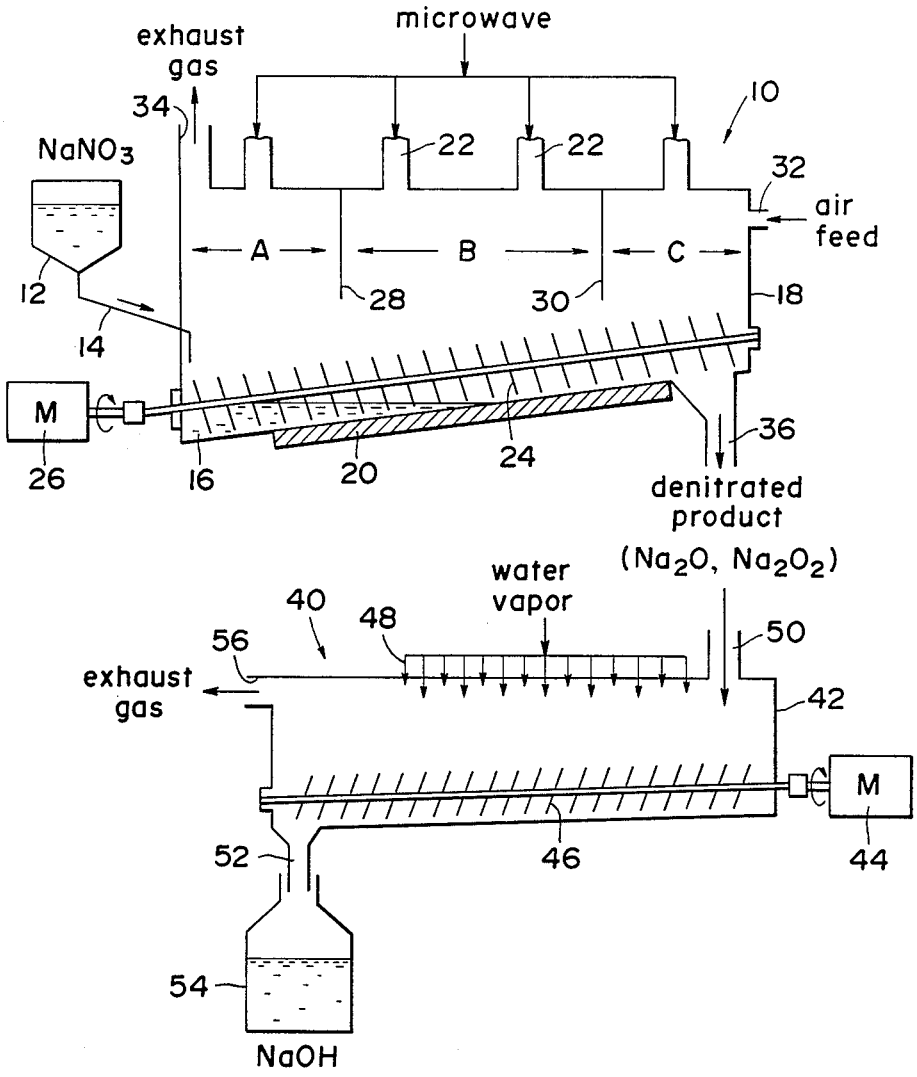
FIG. 2 is a sectional schematic illustration showing an apparatus preferably used for practicing the method of the present invention.

FIG. 2 shows a preferred embodiment of an apparatus to be used in the present invention. This apparatus comprises a heating apparatus 10 and a reaction apparatus 40.

The heating apparatus 10 is provided with a feeder 12 of a radioactive liquid waste and a heating chamber 18 having a bottom tilted so as to form a sink 16 in the heating chamber 18. The feeder 12 and the sink 16 are connected by a pipe 14. The heating chamber 18 is provided with a heater 20 at the bottom and sides of its outer wall and with a plurality of microwave applying apertures 22 at the top thereof. A screw 24 for continuously transferring (discharging) the denitrated product is rotatably provided at the bottom in the heating chamber 18 and can be driven by a driving motor 26 disposed outside the heating chamber 18. Further, the interior of the heating chamber 18 is partitioned into three zones A, B and C by partition plates 28 and 30.

The heating chamber 18 is simultaneously subjected to irradiation with microwave and heating by the heater 20, while the radioactive liquid waste containing fission products and sodium nitrate ($NaNO_3$) is continuously fed to the sink 16 from the feeder 12 via the pipe 14. The screw 24 is rotated by the driving motor 26. In the zone A, the heating and concentration of the radioactive liquid waste are carried out, and in the zone B, the concentration and denitration (decomposition into $NO_x$) of the liquid waste are carried out. The oxygen required in the reaction is fed via an air feed opening 32 provided at the upper part of the heating chamber 18 and the exhaust gas is discharged via an exhaust vent 34. In the zone C, the reaction is completed to form oxides of sodium, i.e., sodium oxide and sodium peroxide. The denitrated product thus obtained is discharged via a discharge opening 36 into the reaction apparatus 40 which will be described below.

The reaction apparatus 40 is provided with a screw 46 at the lower part in a reaction chamber 42 and with a water vapor sprayer 48 at the top of the chamber 42. The screw 46 can be rotated by a driving motor 44.

The denitrated product formed in the heating chamber 10 is fed to the reaction chamber 42 via a feed opening 50 provided at the top thereof and transferred by the screw 46, while being sprayed with water vapor from the sprayer 48 to thereby convert the oxides of sodium in the denitrated product into sodium hydroxide. The denitrated product containing sodium hydroxide and fission products is discharged via a discharge opening 52 to be collected in a collection vessel 54, while the gaseous product generated in the formation of sodium hydroxide is discharged via an exhaust vent 56.

The sodium hydroxide containing fission products thus collected is transferred to the following purification step as shown in FIG. 1.

As described hereinabove, according to the present invention, it becomes possible to reuse sodium contained in the radioactive liquid waste and to remarkably reduce the volume of the radioactive waste to be solidified. In addition, since the sodium content of the radioactive waste to be solidified is greatly reduced, the solidification thereof is significantly facilitated. Accordingly, the vitrification can be carried out with a reduced amount of a glass forming agent to give a vitrified product having excellent properties. In the bitumen solidification, on the other hand, the solidification treatment can be carried out safely with reduced risk of fire or explosion.

Although the present invention has been described with reference to the preferred embodiments thereof, many modifications and alterations may be made within the scope of the appended claims.

What is claimed is:

1. A method of treatment of a radioactive liquid waste comprising the steps of:

heating a radioactive liquid waste containing fission products and a thermally decomposable sodium compound to convert the sodium compound into oxides of sodium, thereby forming a calcination product comprising fission products and oxides of sodium;

converting the oxides of sodium in the calcination product into sodium hydroxide by means of water vapor;

reacting the sodium hydroxide in the calcination product with an alcohol to form a sodium alcoholate;

separating the thus formed sodium alcoholate by means of solid-liquid separation from an impurity residue comprising the fission products; and decomposing the sodium alcoholate with water to form and recover sodium hydroxide.

2. The method according to claim 1, wherein heating of the radioactive liquid waste is carried out by microwave heating.

3. The method according to claim 1, wherein the conversion of the oxides of sodium into sodium hydroxide is carried out by spraying water vapor to the calcination product.

4. The method according to claim 1, wherein the conversion of the oxides of sodium into sodium hydroxide is carried out by reacting the calcination product with carbon dioxide gas to convert the oxides of sodium in the calcination product into sodium carbonate, and then spraying water vapor to the calcination product to convert sodium carbonate into sodium hydroxide.

5. The method according to claim 1, which further comprises melting the separated impurity residue with a glass forming agent to produce a vitrified product.

6. The method according to claim 1, which further comprises mixing the separated impurity residue with bitumen under heating to produce a product solidified by bitumen.

* * * * *